US009574259B2

(12) United States Patent
Miura

(10) Patent No.: US 9,574,259 B2
(45) Date of Patent: Feb. 21, 2017

(54) METHOD FOR PRODUCING HIGH-STRENGTH MAGNESIUM ALLOY MATERIAL AND MAGNESIUM ALLOY ROD

(75) Inventor: Hiromi Miura, Tokyo (JP)

(73) Assignee: The University of Electro-Communications, Tokyo (JP)

( * ) Notice: Subject to any disclaimer, the term of this patent is extended or adjusted under 35 U.S.C. 154(b) by 427 days.

(21) Appl. No.: 14/129,562

(22) PCT Filed: Jun. 19, 2012

(86) PCT No.: PCT/JP2012/065666

§ 371 (c)(1),
(2), (4) Date: Dec. 27, 2013

(87) PCT Pub. No.: WO2013/002082

PCT Pub. Date: Jan. 3, 2013

(65) Prior Publication Data

US 2014/0147331 A1 May 29, 2014

(30) Foreign Application Priority Data

Jun. 28, 2011 (JP) ..... 2011-143042

(51) Int. Cl.
*C22F 1/06* (2006.01)
*C22F 3/00* (2006.01)
(Continued)

(52) U.S. Cl.
CPC .. *C22F 3/00* (2013.01); *B21J 1/02* (2013.01); *C22C 23/00* (2013.01); *C22C 23/02* (2013.01); *C22F 1/06* (2013.01)

(58) Field of Classification Search
CPC ..... B21J 1/02; B21J 5/00; C22C 23/00; C22C 23/02; C22F 1/06; C22F 3/00
(Continued)

(56) References Cited

U.S. PATENT DOCUMENTS 5,620,537 A * 4/1997 Bampton ..... B21J 5/002 148/564
2006/0283529 A1* 12/2006 Ghosh ..... C22F 1/183 148/557
(Continued)

FOREIGN PATENT DOCUMENTS

JP 2004-012296 1/2004
JP 2004-027320 1/2004
(Continued)

OTHER PUBLICATIONS

English translation of the International Preliminary Report on Patentability Chapter II (IPEA/409) for PCT/JP2012/056666; Sep. 27, 2013; 4 pages.*
(Continued)

*Primary Examiner* — Helene Klemanski
(74) *Attorney, Agent, or Firm* — IPUSA, PLLC

(57) ABSTRACT

A method for producing a high-strength magnesium alloy material includes (a) a step of preparing a magnesium alloy workpiece having a top face and a side face; and (b) a step of applying a compressive load σp (MPa) from the top face side of the workpiece and performing a uniaxial forging process on the workpiece. Step (b) is performed while suppressing deformation of the workpiece widening outward and under conditions including (i) σp>σf (where σf is the compressive breaking stress (MPa) of the workpiece); (ii) a plastic deformation rate is less than or equal to 10%, and (iii) a strain rate is less than or equal to 0.1/sec.

10 Claims, 9 Drawing Sheets

(51) Int. Cl.

| | |
|---|---|
| ***C22C 23/00*** | (2006.01) |
| ***C22C 23/02*** | (2006.01) |
| ***B21J 1/02*** | (2006.01) |
| ***B21J 5/00*** | (2006.01) |

(58) Field of Classification Search
USPC ..... 420/402, 407; 72/378
See application file for complete search history.

(56) References Cited

U.S. PATENT DOCUMENTS

| | | | | |
|---|---|---|---|---|
| 2009/0028743 | A1* | 1/2009 | Gupta | C22F 1/06 420/405 |
| 2009/0116994 | A1* | 5/2009 | Luo | C22F 1/06 420/405 |
| 2009/0165903 | A1* | 7/2009 | Miura | C22F 1/00 148/559 |
| 2010/0254848 | A1* | 10/2010 | Inoue | C22C 23/02 420/408 |
| 2015/0152527 | A1* | 6/2015 | Inoue | C22C 23/02 420/407 |

FOREIGN PATENT DOCUMENTS

| | | |
|---|---|---|
| JP | 2009-172657 | 8/2009 |
| JP | 2010-000515 | 1/2010 |
| JP | 2011-121118 | 6/2011 |

OTHER PUBLICATIONS

English translation of JP 2004/027320; Jan. 2004; 16 pages.*
English translation of JP 2009/172657; Aug. 2009; 16 pages.*
International Search Report mailed on Sep. 25, 2012.
Formation and Mechanical Properties of Mg97 Zn1 RE2 Alloys with Long-Period Stacking Ordered Structure, Y. Kawamura and M. Yamasaki, Materials Transactions, vol. 48, No. 11, p. 2986-p. 2992, 2007.
Extended European Search Report dated Dec. 4, 2014.
Li Qizhen: "Dynamic mechanical response of magnesium single crystal under compression loading: Experiments, model, and simulations", Journal of Applied Physics, American Institute of Physics,US, vol. 109, No. 10, May 18, 2011 (May 18, 2011), pp. 103514-103514.
Knezevic M et al: "Deformation twinning in AZ31: Influence on strain hardening and texture evolution", Acta Materialia, Elsevier, Oxford, GB, vol. 58, No. 19, Nov. 1, 2010 (Nov. 1, 2010), pp. 6230-6242.
Wang et al: "The role of twinning and untwinning in yielding behavior in hot-extruded Mg—Al—Zn alloy", Acta Materialia, Elsevier, Oxford, GB, vol. 55, No. 3, Jan. 4, 2007 (Jan. 4, 2007), pp. 897-905.

* cited by examiner

METHOD FOR PRODUCING HIGH-STRENGTH MAGNESIUM ALLOY MATERIAL AND MAGNESIUM ALLOY ROD

TECHNICAL FIELD

The present invention relates to a method for producing a high-strength magnesium alloy material.

BACKGROUND ART

Magnesium alloys (including magnesium metal) are lightweight and have high specific strength. As such, they are expected to be widely used as next-generation lightweight structural materials.

On the other hand, magnesium alloys are hard-to-work materials that are known to easily crack or produce defects in the case where conventional processes such as a rolling process or forging are used. Thus, improving the strength of a magnesium alloy material through a work hardening process has been a challenge, and application fields of magnesium alloy materials have been limited to small electronic equipment components and similar applications in which material strength is not such an important factor.

In recent years, techniques have been disclosed for improving the strength of magnesium alloys by adding transition metals and certain rare earth metals to magnesium (see e.g., Non-Patent Documents 1 and 2).

PRIOR ART DOCUMENTS

Non-Patent Literature Documents

Non-Patent Document 1: Y. Kawamura and M. Yamasaki, Materials Transactions, Vol. 48, pp. 2986-2992 (2007)

Non-Patent Document 2: Y. Kawamura and K. Higashida, "Strengthening of high strength Magnesium alloys with long period stacking ordered structure," Light Metal Education Foundation Research Project Final Report, Light Metal Education Foundation (2010)

SUMMARY OF THE INVENTION

Problem to be Solved by the Invention

The magnesium alloys described in Non-Patent Documents 1 and 2 are also referred to as KUMADAI magnesium alloy. In the KUMADAI magnesium alloy, alloy strength is improved by adding rare earth metal elements and causing the development of a special atomic structure (long-period stacking ordered structure) within the alloy structure.

However, to produce the KUMADAI magnesium alloy, rare earth metal elements have to be added at a weight ratio of approximately 5% to 7% or higher to control the alloy composition. Also, these rare earth metal elements are generally expensive, and in recent years, stable supply of these elements is becoming an issue. Accordingly, applications of the magnesium alloy materials disclosed in Non-Patent Documents 1 and 2 may be limited to high-quality value-added products.

In view of the above, it is an object of at least one embodiment of the present invention to provide a comparatively simple and inexpensive method for producing a high-strength magnesium alloy material.

Means for Solving the Problem

According to one embodiment of the present invention, a method for producing a high-strength magnesium alloy material includes:

(a) a step of preparing a magnesium alloy workpiece having a top face and a side face; and (b) a step of applying a compressive load $\sigma p$ (MPa) from the top face side of the workpiece and performing a uniaxial forging process on the workpiece;

wherein step (b) is performed while suppressing deformation of the workpiece widening outward under conditions including (i) $\sigma p > \sigma f$ (where $\sigma f$ is the compressive breaking stress (MPa) of the workpiece), (ii) a plastic deformation rate is less than or equal to 10%, and (iii) a strain rate is less than or equal to 0.1/sec.

Note that the plastic deformation rate is defined by a change ratio of the volume of the workpiece before and after the forging process. Also, the strain rate is defined by the initial strain rate.

In one preferred embodiment of the method according to the present invention, $\sigma p \geq 2.4\sigma f$.

In another preferred embodiment, a mold having an inner space for accommodating the workpiece is used in step (b), and the inner space is formed by an inner wall of the mold. Assuming L denotes the maximum dimension of the top face of the workpiece, and P denotes the maximum gap between the side face of the workpiece and the inner wall of the mold, the ratio (L:P) may be within a range from 20:1 to 600:1.

In another preferred embodiment, the inner space of the mold is formed by assembling a plurality of mold members.

In another preferred embodiment, the inner space does not have to penetrate through the mold.

In another preferred embodiment, a size of the inner space may vary along its depth direction.

According to another embodiment of the present invention, a magnesium alloy rod has a longitudinal direction substantially parallel to the c-axis direction.

According to another embodiment of the present invention, a magnesium alloy material produced by one of the above methods of the present invention is provided. The magnesium alloy material may have the shape of a rod, a plate, a block, or a pellet, or a tube.

Advantageous Effect of the Invention

According to an aspect of the present invention, a comparatively simple and inexpensive method for producing a high-strength magnesium alloy material may be provided.

EMBODIMENTS FOR IMPLEMENTING THE INVENTION

Figure 1:
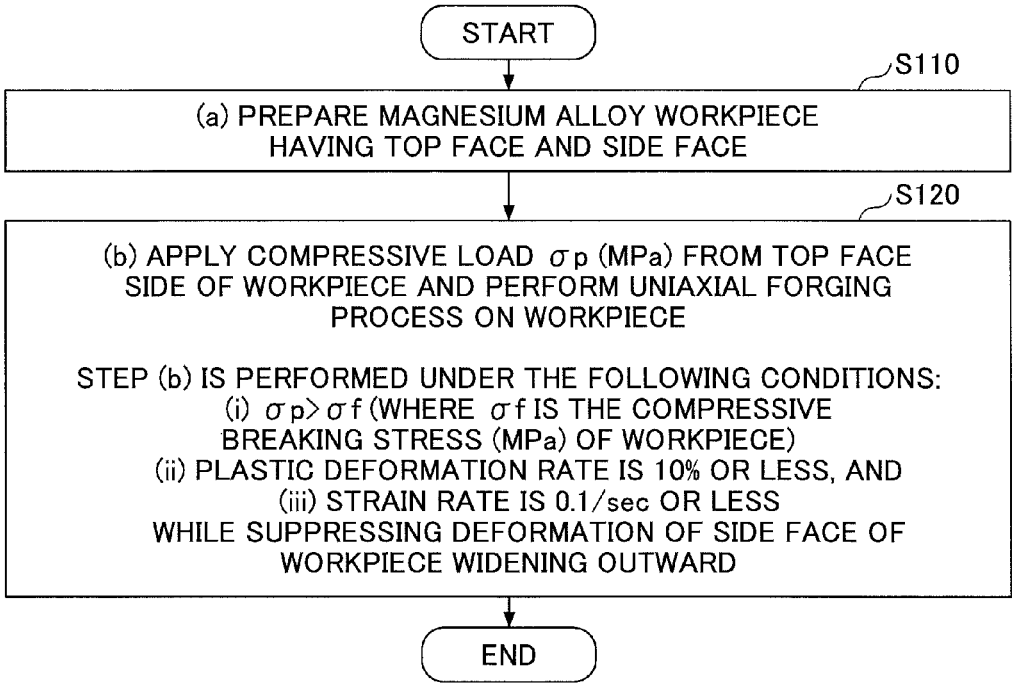
FIG. 1 is a flowchart illustrating a method for producing a high-strength magnesium alloy material according to an embodiment of the present invention.

In general, magnesium alloy materials have poor workability so that they may easily crack or incur defects when conventional work processes such as forging or a cold rolling process are performed thereon. Thus, in the case of working a magnesium alloy material, a large amount of distortion cannot be introduced, and improving the strength of the magnesium alloy material through a work hardening process has been difficult.

In recent years, techniques have been disclosed for increasing the strength of a magnesium alloy by adding rare earth metal elements in the alloy and developing a long period stacking ordered structure within the alloy structure (KUMADAI magnesium alloy).

However, to produce the KUMADAI magnesium alloy, rare earth metal elements have to be added at a weight ratio of approximately 5% to 7% or higher to control the alloy composition. Also, these rare earth metal elements are generally expensive. Thus, magnesium alloys obtained using the above techniques may become expensive as well. Further, the use of rare earth metal elements is not very favorable from the standpoint of securing a stable supply of materials.

On the other hand, as described in detail below, a method for producing a high-strength magnesium alloy material conceived by the inventors of the present invention does not require adding such expensive rare earth metal elements to control the alloy composition. Also, in the present invention, a high-strength magnesium alloy may be produced through a forging process. In this way, a high-strength magnesium alloy may be produced by a comparatively simple and inexpensive method.

According to one embodiment of the present invention, a method for producing a high-strength magnesium alloy material includes:

(a) a step of preparing a magnesium alloy workpiece having a top face and a side face; and (b) a step of applying a compressive load $\sigma p$ (MPa) from the top face side of the workpiece and performing a uniaxial forging process on the workpiece;

wherein step (b) is performed while suppressing deformation of the workpiece widening outward under conditions including (i) $\sigma p > \sigma f$ (where $\sigma f$ is the compressive breaking stress (MPa) of the workpiece), (ii) a plastic deformation rate is 10% or less, and (iii) a strain rate is 0.1/sec or less.

In the above method for producing a high-strength magnesium alloy material, a heavy compressive load $\sigma p$ that satisfies formula (1) indicated below is applied to the workpiece.

$$\sigma p > \sigma f \quad (1)$$

Note that of represents the compressive breaking stress of the workpiece in the application direction of the compressive load $\sigma p$ in the case where the workpiece is free of deformation constraints.

Forging processes are generally not performed under the above condition on workpieces made of hard-to-work materials. That is, when a heavy compressive load $\sigma p$ as described above is applied to the workpiece, the workpiece is prone to break.

However, in the method according to the present embodiment, a heavy compressive load $\sigma p$ satisfying the above formula (1) may be applied to the workpiece without causing the magnesium alloy material workpiece to break. In the present embodiment, this is achieved by performing a forging process "slowly" while the side face of the workpiece is "constrained" and the plastic deformation rate is restricted to a small value.

That is, in the present embodiment, the side face of the workpiece is "constrained," the strain rate is adjusted to be less than or equal to 0.1/sec, and the plastic deformation rate is adjusted to be less than or equal to 10%. In this way, a uniaxial forging process may be performed on the workpiece while preventing the workpiece from cracking or breaking even when applying a heavy compressive load $\sigma p$ satisfying the above formula (1) to the workpiece.

Note that in the descriptions below, "constraint" of the side face of the workpiece or to "constrained" deformation of the side face of the workpiece refers to suppressing free deformation of the side face of the workpiece during a forging process. For example, the expression may refer to suppressing deformation of the side face of the workpiece widening outward from its original position.

According to an aspect of the present invention, after the forging process is performed, a large number of deformation twins may be introduced into the crystal structure and dislocation density may be improved by slip deformation. In this way, work hardening through the forging process may be enabled and the strength of the workpiece may be increased.

Note that the compressive load $\sigma p$ applied to the workpiece may be any value that satisfies formula (1). However, the compressive load $\sigma p$ is preferably set as high as possible to obtain greater strength improvement effects. For example, in one preferred embodiment, the compressive load $\sigma p$ may be arranged to be $\sigma p \geq 2.4\sigma f$, and more preferably $\sigma p \geq 3\sigma f$.

However, when the compressive load $\sigma p$ is increased to an excessively high value, the workpiece may be prone to cracking or breaking even when the forming process is performed under conditions (ii) and (iii) described above. Thus, in a preferred embodiment, the compressive load $\sigma p$ is arranged to satisfy formula (2) indicated below.

$$\sigma p < 10\sigma f \quad (2)$$

(Specific Configuration of Method According to the Present Embodiment)

In the following, the method according to the present embodiment is described with reference to the accompanying drawings.

FIG. 1 is a flowchart illustrating a method for producing a high strength magnesium alloy material according to an embodiment of the present invention.

As illustrated in FIG. 1, the method for producing a high-strength magnesium alloy material according to the present embodiment includes:

(a) a step of preparing a magnesium alloy workpiece having a top face and a side face (step S110); and (b) a step of applying a compressive load σp from the top face side of the workpiece and performing a uniaxial forging process on the workpiece (step S120); wherein step (b) is performed under the conditions indicated below (i) σp>σf (where σf is the compressive breaking stress (MPa) of the workpiece), (ii) plastic deformation rate is 10% or less, and (iii) strain rate is 0.1/sec or less while suppressing deformation of the workpiece widening outward.

In the following, the above process steps are described in greater detail.

(Step S110)

First, a magnesium alloy workpiece is prepared.

Figure 2:
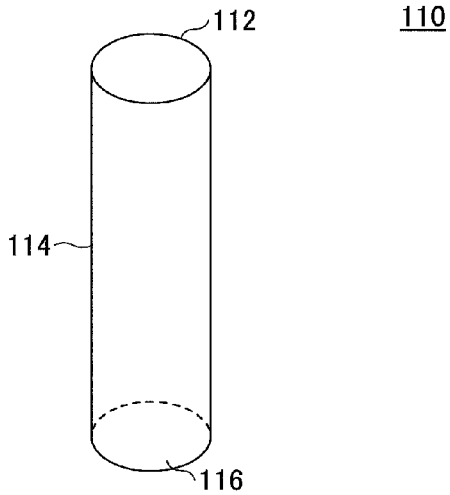
FIG. 2 illustrates an exemplary configuration of a workpiece.

FIG. 2 illustrates an exemplary configuration of a workpiece 110.

As illustrated in FIG. 2, the workpiece 110 has a substantially cylindrical shape and includes a top face 112, a side face 114, and a bottom face 116. Note, however, that the configuration illustrated in FIG. 2 is merely one example, and the workpiece 110 may have other shapes and configurations. For example, the workpiece 110 may be arranged into a rod, a block, a conical shape, a truncated conical shape, a pyramidal shape, a truncated pyramid shape, a plate (including a disk), a pellet shape, or a tubular shape. That is, the workpiece 110 may be arranged into any shape that includes a top face and a side face.

Note that in the present descriptions, the terms "top face" and "side face" are used to describe relative locations of the workpiece. That is, the "top face" refers to a face of the workpiece that comes into contact with a press mandrel (member for applying a compressive load to the workpiece) while a forging process is performed on the workpiece. The "top face" is substantially perpendicular to the direction in which the compressive load is applied. The "side face" of the workpiece refers to a face that is adjacent to the "top face" of the workpiece.

Thus, for example, in a case where the workpiece is prismatic, and the workpiece is compressed in a direction parallel to the longitudinal direction of the workpiece, the "top surface" refers to one end face of the workpiece, and the "side face" refers to at least one of a plurality of faces extending in the longitudinal direction of the workpiece.

Also, for example, in a case where the workpiece is tubular, and the workpiece is compressed in a direction parallel to the longitudinal direction of the workpiece, the "upper face" of the workpiece refers to one end face of the work piece having a tubular opening, and the "side face" refers to an outer peripheral face and/or an inner peripheral face of tubular structure extending in the longitudinal direction.

The workpiece 110 is made of a magnesium alloy material. The material of the workpiece 110 is not particularly limited as long as it includes a magnesium alloy. For example, an AZ-based magnesium alloy (magnesium alloy containing zinc and aluminum), a rare-earth-element-doped magnesium alloy, or a Ca-doped magnesium alloy may be used as the material of the workpiece 110.

Further, the present invention may be applied to hard-to-work materials other than magnesium alloys including, but not limited to, titanium alloys, zirconium alloys, molybdenum alloys, and niobium alloys, for example.

(Step S120)

Next, a forging process is performed on the workpiece 110.

Figure 3:
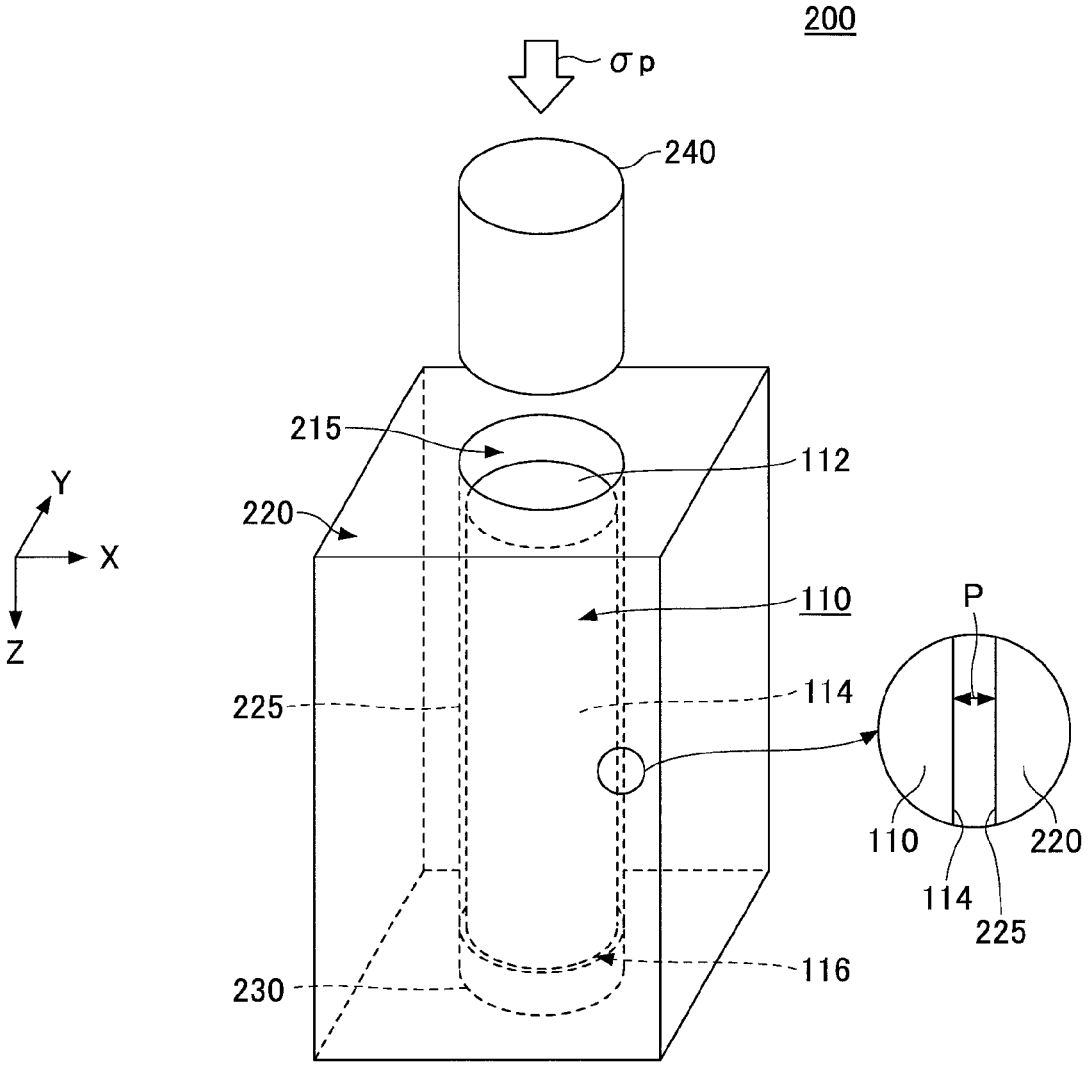
FIG. 3 illustrates an exemplary apparatus for implementing the method according to an embodiment of the present invention.

FIG. 3 illustrates an exemplary configuration of an apparatus 200 that may be used in the method for producing a high-strength magnesium alloy material according to an embodiment of the present invention.

As illustrated in FIG. 3, the apparatus 200 used in the present embodiment includes a mold 220 having an inner space 215, a base member 230 arranged at a bottom portion of the inner space 215 of the mold 220, and a press mandrel 240. Note, however, that in some embodiments, the base member 230 may be omitted.

The mold 220 has an inner wall 225 that forms the inner space 215.

Note that although the materials of the mold 220, the base member 230, and the press mandrel 240 are not particularly limited, materials having a high compressive strength including, but not limited to, steel materials for molds and super hard ceramics, for example, are preferably used.

Upon performing a forging process, the workpiece 110 is accommodated within the inner space 215 of the mold 220. In this case, the workpiece 110 is positioned within the inner space 215 of the mold 220 such that the bottom face 116 comes into contact with the base member 230 and the side face 114 faces the inner wall 225 of the mold 220. Also, during the forging process, the press mandrel 240 is arranged above the top face 112 of the workpiece 110.

Further, a small gap P is formed between the side face 114 of the workpiece 110 and the inner wall 225 forming the inner space 215 of the mold 220.

During the forging process, the press mandrel 240 is pressed against the top face 112 of the workpiece 110, and the press mandrel 240 moves along the longitudinal direction of the workpiece 110 (Z direction of FIG. 3). In this way, a compressive load σp (MPa) may be applied to the workpiece 110.

In the present embodiment, assuming of denotes the compressive breaking stress in the longitudinal direction of the workpiece 110, the compressive load σp (MPa) applied to the workpiece 110 satisfies formula (1) indicated below.

$$\sigma p > \sigma f \quad (1)$$

Normally, a forging process under conditions satisfying the above formula (1) would not be performed on a workpiece that is made of a hard-to-work material. This is because the workpiece would most likely break when such a heavy compressive load σp is applied to the workpiece.

In the present embodiment, only a small gap is provided between the side face 114 of the workpiece 110 and the inner wall 225 forming the inner space 215 of the mold 220. Accordingly, even when the workpiece 110 receives compression deformation forces generated by the forging process, the side wall 114 of the workpiece 110 may be "constrained" by the inner wall 225 of the mold 220 or prevented from deforming outward to a large extent (such deformation being referred to as "constrained deformation" hereinafter). Also, during the forging process, the strain rate of the workpiece 110 is controlled to be less than or equal to 0.1/sec, and the plastic deformation rate of the workpiece 110 is controlled to be less than or equal to 10%. For example the plastic deformation rate of the workpiece 110 may be adjusted to be within a range from 2% to 8%.

By implementing the above-described measures, in the present embodiment, a heavy compressive load σp may be applied to the workpiece 110 without causing the workpiece 110 to break or incur defects.

The gap P between the workpiece 110 and the inner wall 225 may vary depending on the plastic deformation rate and/or the maximum length of the top face 112 of the workpiece 110 (denoted as "L"). For example, a ratio of the gap P to the maximum length L of the top face 112 of the workpiece 110 (P:L) may be arranged to be within a range from 1:20 to 1:600. (Note that a total gap between the inner wall 225 and the workpiece 110 with respect to a direction parallel to the top face 112 (XY plane) equals 2P at the maximum.)

According to an aspect of the present invention, after a forging process is performed, a large number of deformation twins may be introduced into the crystal structure and dislocation density may be improved by slip deformation. In this way, work hardening through the forging process may be enabled and the strength of the workpiece 110 may be increased after the forging process.

Figure 4:
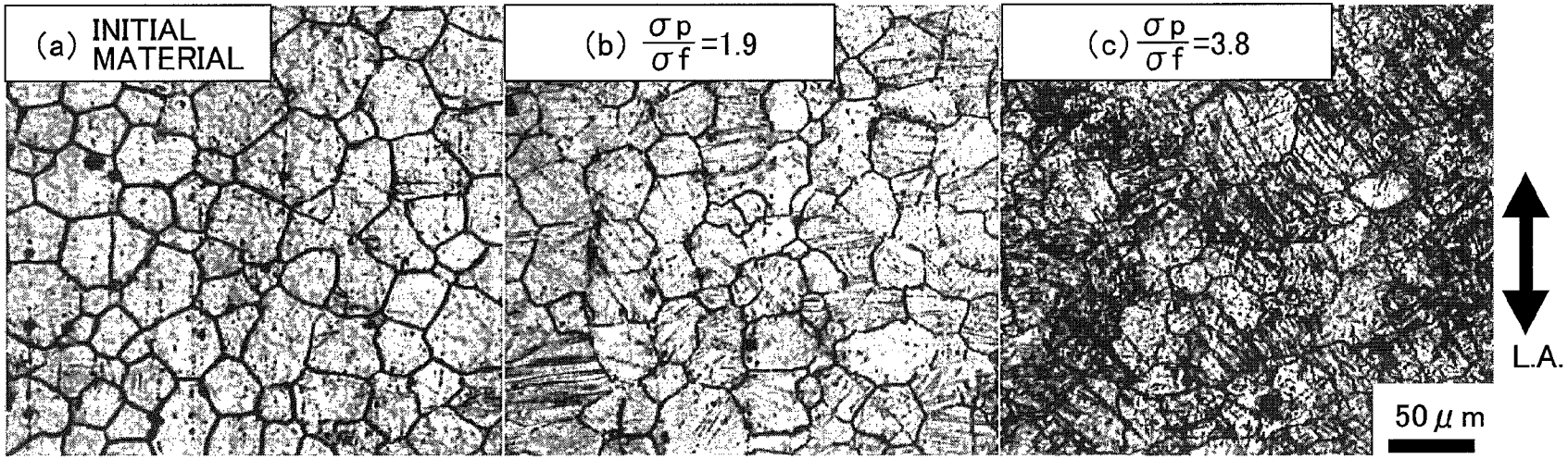
FIG. 4 illustrates structures (optical micrographs) of the workpiece before and after a forcing process according to an embodiment of the present invention is performed.

FIG. 4 illustrates exemplary structures (optical micrographs) of a workpiece before and after a forging process according to the present embodiment is performed. The micrograph on the left side of FIG. 4 illustrates the state of the workpiece before the forging process is performed. The micrograph at the center illustrates the state of the workpiece after a forging process is performed using a compressive load σp that satisfies the condition σp/σf=1.9. The micrograph at the right side illustrates the state of the workpiece after a forging process is performed using a compressive load σp that satisfies the condition σp/σf=3.8.

Note that a workpiece made of an AZ-based magnesium alloy (8 wt % Al-wt % Zn—Mg) was used in the present example, and the strain rate of the workpiece was adjusted to $10^{-3}$/sec while the plastic deformation rate of the workpiece was adjusted to 3%. Also, the gap P was arranged so that the ratio (P:L)=1:102.

As can be appreciated from FIG. 4, more deformation twins may be introduced into the crystal structure as the compressive load σp is increased. Also, no significant change in the crystal grain structure can be observed other than the introduction of the deformation twins. Based on the above, it may be understood that in the present embodiment, the initial crystal grain structure may remain substantially intact, and a large number of deformation twins may be introduced in such a state.

The above results suggest that by slowly performing compression deformation while restricting the extent of deformation through "constrained deformation," the workpiece may be prevented from breaking even when a heavy compressive load σp is applied to the workpiece during the forging process, and a large number of deformation twins may be generated.

Figure 5:
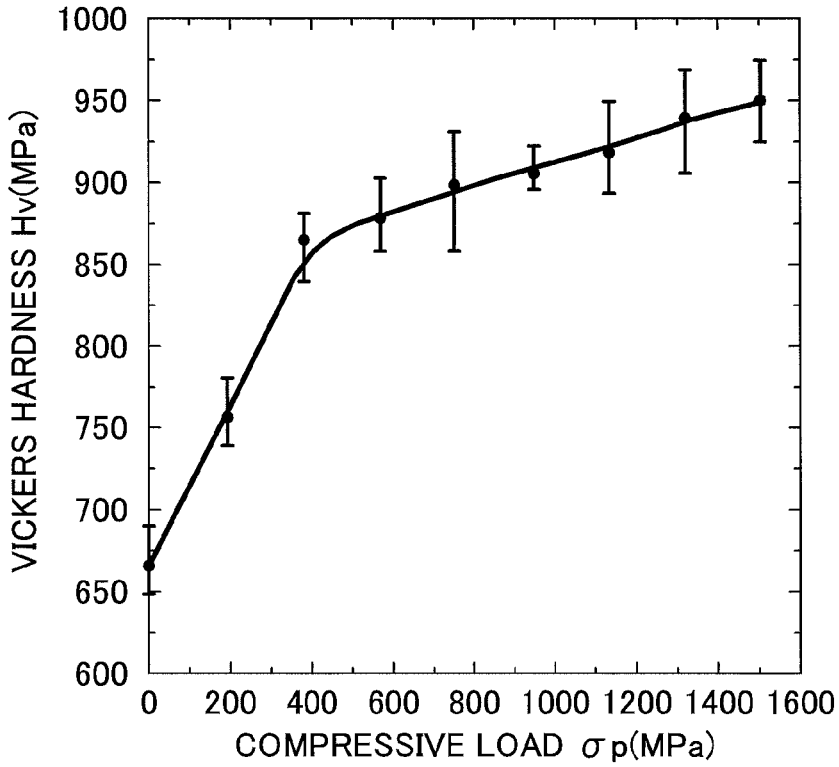
FIG. 5 is a graph illustrating an exemplary relationship between a compressive load $\sigma p$ applied to the workpiece and the hardness of the workpiece.

FIG. 5 is a graph illustrating an exemplary relationship between the compressive load σp applied to the workpiece and the hardness of the workpiece. Note that in the present example, a workpiece made of an AZ-based magnesium alloy (8 wt % Al-wt % Zn—Mg) was used, and the strain rate of the workpiece was adjusted to $10^{-3}$/sec. Also, the ratio (P:L) during the forging process was adjusted to be 1:102.

As can be appreciated from FIG. 5, the hardness of the workpiece increases as the compressive load σp is increased. The measurement results of FIG. 5 indicate that work hardening of the workpiece may be achieved by performing the forging process according to the present embodiment. That is, by performing the forging process according to the present embodiment, deformation twins and dislocations may be generated within the crystal structure, and in this way, the strength of the workpiece may be increased.

(Other Configuration of Apparatus Used in Method of Present Embodiment)

An example has been described above in which the apparatus 200 illustrated in FIG. 3 is used to implement the method of the present embodiment on a workpiece. However, FIG. 3 merely illustrates one example of an apparatus that may be used in the present embodiment, and it is apparent to persons skilled in the art that other various apparatuses may be used to implement the method of the present embodiment. For example, the mold used in the apparatus is not limited to the mold 220; rather, molds with other various shapes and configurations may alternatively be used. Also, numerous variations and modifications of the base member and/or the press mandrel may be conceived as well.

In the following, exemplary configurations of other molds that may be used in the present embodiment is described with reference to FIGS. 6-8.

Figure 6:
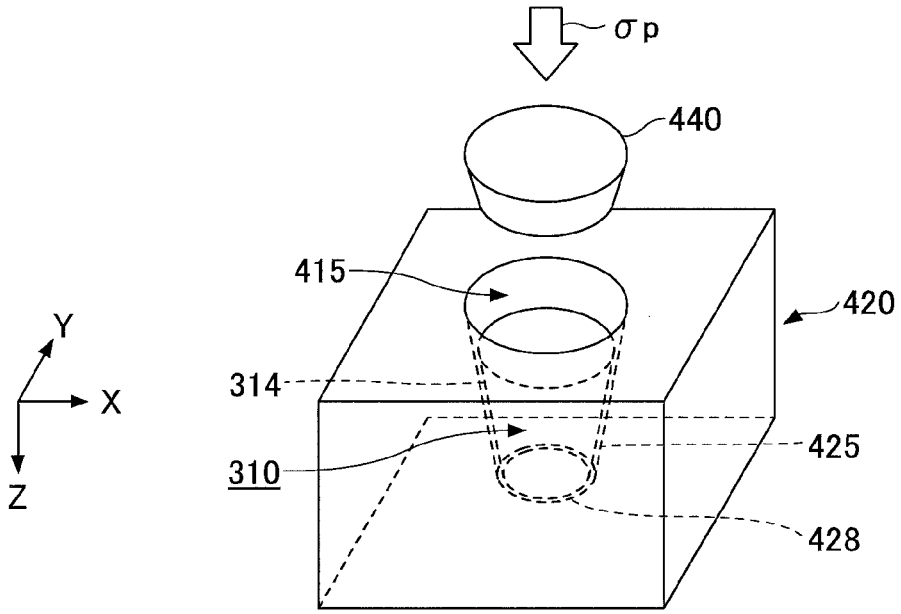
FIG. 6 illustrates a configuration of another mold that may be used in an embodiment of the present invention.

FIG. 6 illustrates a configuration of another mold 420 that may be used in the present embodiment.

As illustrated in FIG. 6, the mold 420 has an inner space 415 that is capable of accommodating a truncated conical shaped workpiece 310.

Note that the inner space 415 does not penetrate through the mold 420 so that one end of the inner space is closed. Thus, the mold 420 does not necessarily have to include a base member like the base member 230 illustrated in FIG. 3. The inner space 415 is formed by an inner wall 425 and a bottom wall 428. As in the example described above, a gap P is formed between a side wall 314 of the workpiece 310 and the inner wall 425.

In the case of performing a forging process on the workpiece 310 using the mold 420, a press mandrel 440 having a shape matching the shape of the top portion of the inner space 415 is used. By moving the press mandrel 440 along the longitudinal direction (Z direction of FIG. 6) of the workpiece 310, a compressive load σp may be applied to the workpiece 310.

Figure 7:
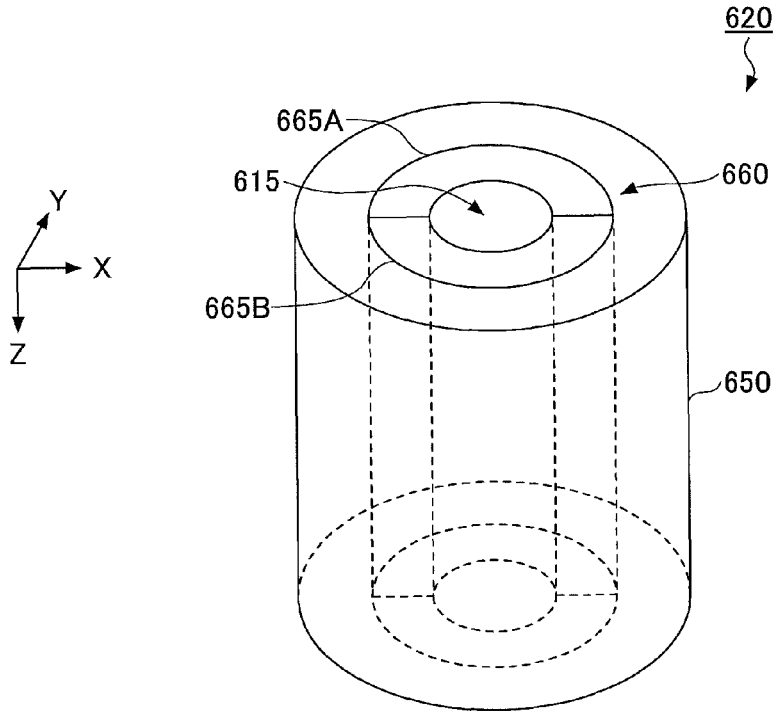
FIG. 7 illustrates a configuration of yet another mold that may be used in an embodiment of the present invention.
Figure 8:
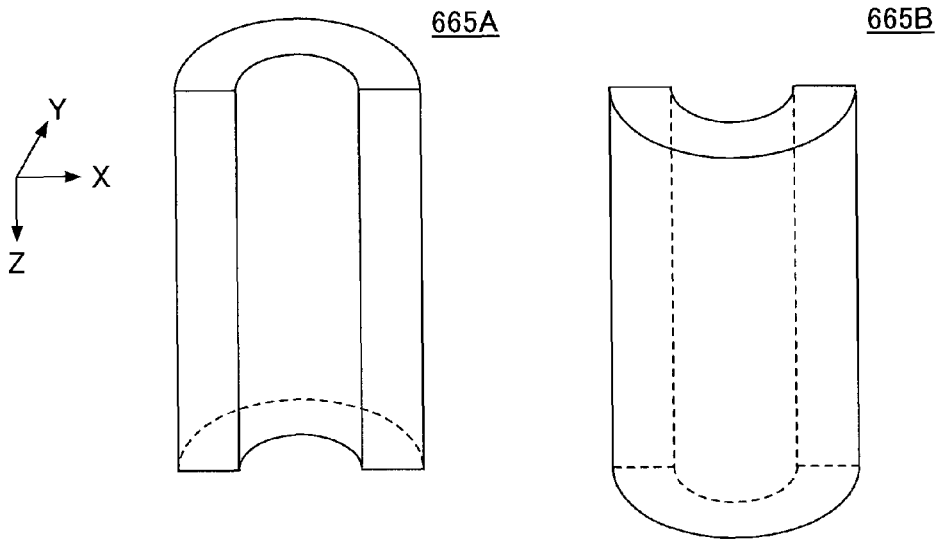
FIG. 8 illustrates configurations of mold members 665A and 665B that are used in the mold illustrated in FIG. 7.

FIGS. 7 and 8 illustrate an exemplary configuration of another mold 620 that may be used in the present embodiment.

As illustrated in FIG. 7, the mold 620 includes an outer housing 650 and an inner mold 660. The inner mold 660 has an inner space 615 for accommodating a workpiece (not shown) at its center. The inner mold 660 is formed by assembling together two mold members 665A and 665B.

As illustrated in FIG. 8, the mold members 665A and 665B forming the inner mold 660 have substantially identical shapes. That is, the mold members 665A and 665B are arranged into a shape of a cylinder that is divided in half along its longitudinal direction (Z direction). By assembling the mold members 665A and 665B together, the inner space 615 that extends in the longitudinal direction may be formed at a center portion of the assembled structure.

By using such a "divided" inner mold 660, a workpiece may be easily removed from the mold 620 after the forging process.

Note that in the example illustrated in FIGS. 7 and 8, the inner mold 660 and the inner space 615 have substantially cylindrical shapes. However, the shapes and configurations of the inner mold 660 and the inner space 615 are not limited to the illustrated example. For example, the inner mold 660 and the inner space 615 may have conical shapes with their diameters becoming smaller from one end to the other end in the longitudinal direction (i.e., tapered shape). In another example, the outer periphery of the inner mold 660 may be tapered. In this way, removal of the mold members 665A and 665B and the workpiece from the outer housing 650 after the forging process may be further facilitated.

Also, the number of mold members making up the inner mold 660 is not particularly limited. That is, the inner mold 660 may be formed by assembling three or more mold members, for example.

Further, the configurations of the press mandrel and/or the base member are not limited to those having flat contact faces that respectively come into contact with the top face and the bottom face of the workpiece.

Figure 9:
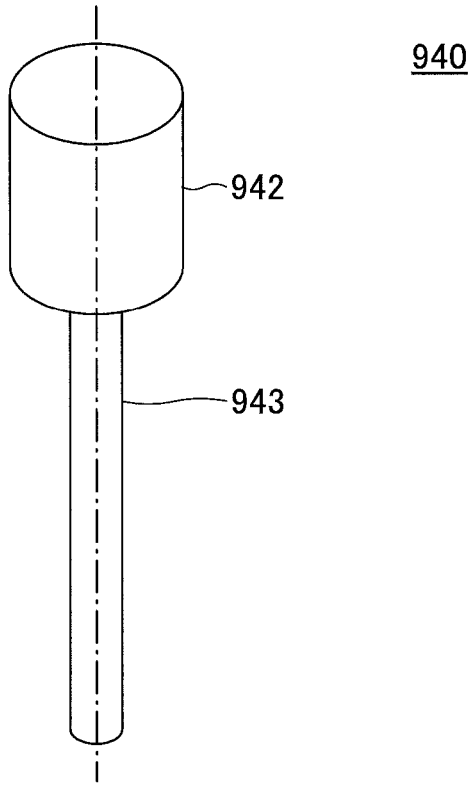
FIG. 9 illustrates a configuration of another press mandrel that may be used in an embodiment of the present invention.
Figure 10:
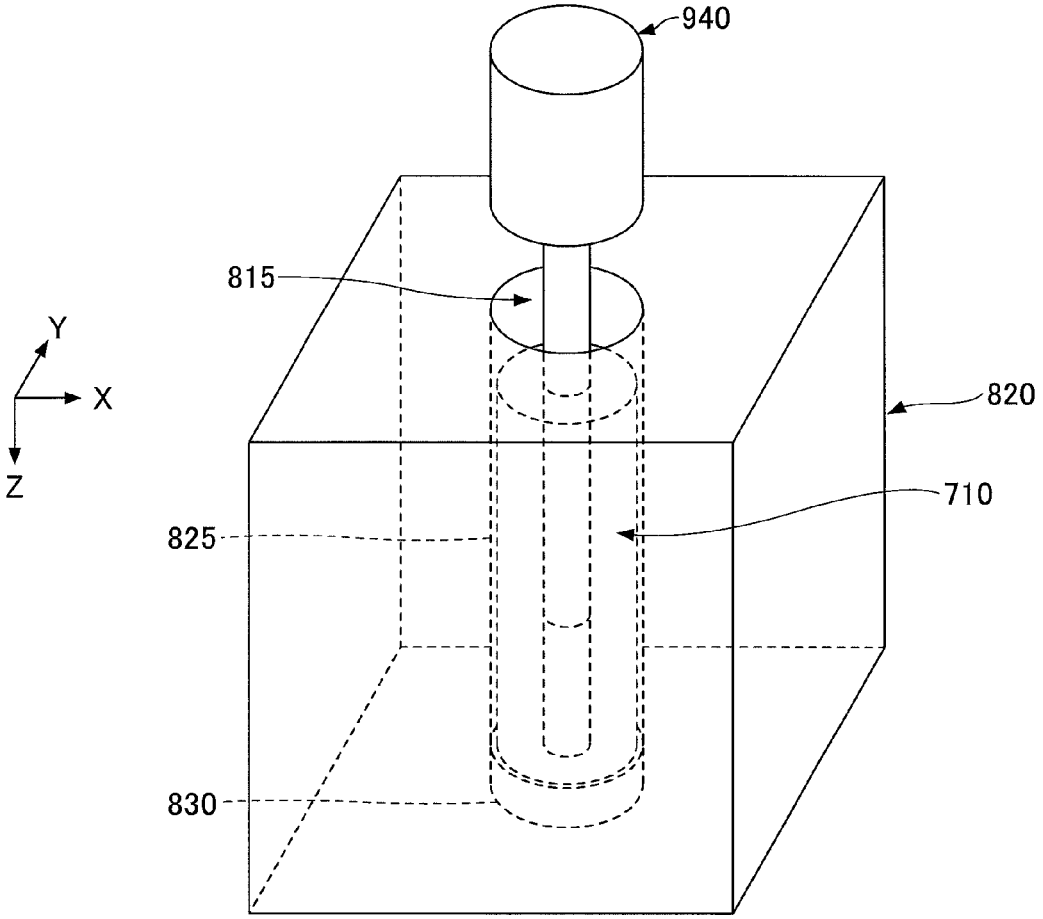
FIG. 10 illustrates an exemplary use mode of the press mandrel illustrated in FIG. 9.

FIGS. 9 and 10 illustrate an exemplary configuration of another press mandrel 940 that may be used in the present embodiment.

As illustrated in FIG. 9, the press mandrel 940 includes an upper part 942 and an extension part 943 that is coupled to the upper part 942. The extension part 943 extends along the axial direction of the press mandrel 940.

The press mandrel 940 with the above configuration may be suitably used in a case where the workpiece has a tubular shape.

FIG. 10 illustrates an exemplary configuration of an apparatus that uses the above press mandrel 940.

As illustrated in FIG. 10, the apparatus includes a mold 820 having an inner space 815 defined by an inner wall 825. A workpiece 710 having a tubular shape is arranged inside the inner space 815. The workpiece 710 is placed above a base member 830 of the mold 820. The press mandrel 940 as illustrated in FIG. 9 is arranged above the workpiece 710 with the extension part 943 penetrating through a through hole of the workpiece 710.

By applying a compressive load to the upper part 942 of the press mandrel 940 along the Z direction, the workpiece 710 may be compressively deformed.

Meanwhile, deformation of an outer periphery side face of the workpiece 710 is "constrained" such that the outer periphery side face of the workpiece 710 can only be deformed (widened) outward up to a point where the gap between the outer periphery side face of the workpiece 710 and the inner wall 825 closes. Similarly, deformation of an inner periphery side face of the workpiece 710 is "constrained" by the extension part 943 of the press mandrel 940 such that the workpiece 710 can only be deformed up to a point where a gap between the inner periphery side face of the workpiece 710 and the extension part 943 of the press mandrel 940 closes.

Thus, in the present example, "constrained deformation" may be implemented with respect to the overall configuration of the workpiece 710 during the forging process so that the through hole of the workpiece 710 may be prevented from closing and the overall strength of the workpiece 710 may be increased.

Figure 11:
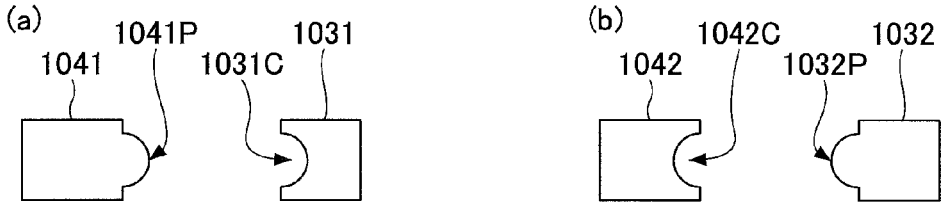
FIG. 11 illustrates other exemplary configurations of the press mandrel and/or the base member that may be used in an embodiment of the present invention.

FIG. 11 illustrates other exemplary configurations of the press mandrel and/or base member.

In the example illustrated in FIG. 11 (*a*), a press mandrel 1041 has a convex part 1041P arranged at a contact face that comes into contact with a workpiece, and a base member 1031 has a concave part 1031C arranged at a contact face that comes into contact with the workpiece. In the example illustrated in FIG. 11 (*b*), a press mandrel 1042 has a concave part 1042C arranged at a contact face that comes into contact with a workpiece, and a base member 1032 has a convex part 1032P arranged at a contact face that comes into contact with the workpiece. In other examples, the contact face of the press mandrel may be arranged flat and the contact face of the base member may be arranged to have a convex part or a concave part. Conversely, the contact face of the base member may be arranged flat and the contact face of the press mandrel may have a convex part or a concave part.

Note that the apparatus used in the present embodiment may have numerous other configurations. For example, the inner space for accommodating a workpiece may be arranged to have a relatively simple configuration as described above, or alternatively, the inner space may have a more complicated configuration approximating the outer shape of a final molded product, for example. Also, the gap P between the side face of the workpiece and the inner wall of the mold may be arranged to vary in the depth direction (forging direction), for example.

Practical Examples

In the following, practical examples of the present invention are described.

(Forging Process)

Disk-shaped samples were prepared from a commercially available AZ80 magnesium alloy rod produced by hot extrusion (by Osaka Fuji Corporation). The samples were arranged to have a diameter L of 25.5 mm and a total length of 16 mm.

Figure 12:
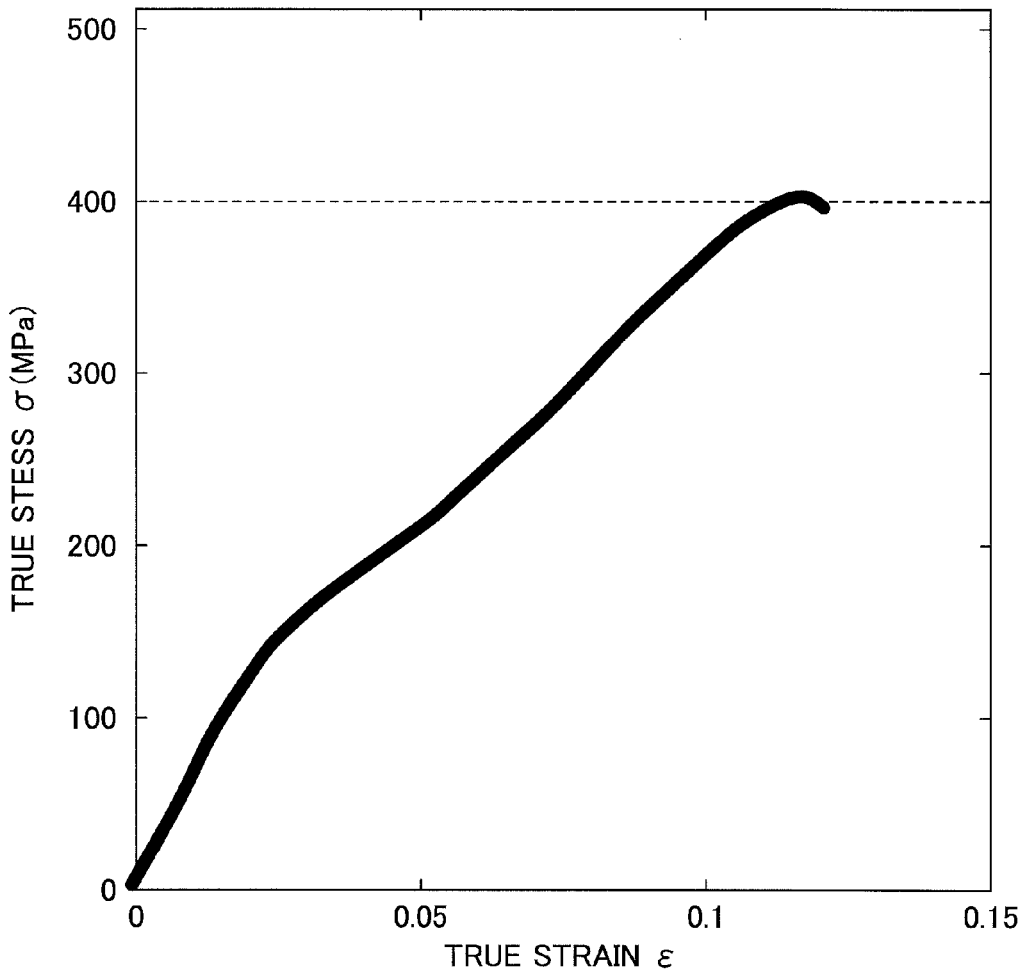
FIG. 12 is a graph illustrating measurement results of a compressive stress-strain curve in the longitudinal direction of a pre-forging sample.

FIG. 12 is a graph illustrating measurement results of the compressive stress-strain curve in the longitudinal direction of the sample before a forging process was performed (pre-forging sample). Note that the present experiment was conducted under room temperature, and the initial strain rate was adjusted to $3.0\times10^{-3}$/sec. Also, in this experiment, deformation of the sample was not constrained, and the sample was able to freely expand and widen outward during compression.

As can be appreciated from FIG. 12, the compressive breaking stress of the pre-forging sample under the above conditions where deformation is not constrained is approximately 400 MPa.

Next, an apparatus similar to the apparatus 200 illustrated in FIG. 3 was used to perform a compressive forging process on the sample at room temperature.

First, the sample was arranged within an inner space of a mold. The inner space penetrates through the mold and has a circular disk shape with a diameter of 26 mm and a total length of 16 mm. When the sample was arranged within the inner space, the gap P between the side face of the sample and the inner wall of the mold was 0.25 mm. Thus, L:P=25.5:0.25=102:1.

Next, a press mandrel was placed above the sample. The press mandrel has a diameter of 25.5 mm.

In this state, a compressive load $\sigma p$ was applied to the sample via the press mandrel, and the sample was compressed along its longitudinal direction. Note that the initial strain rate was adjusted to $1\times10^{-3}$/sec, and the plastic deformation rate was adjusted to 3%.

The compressive load $\sigma p$ was varied with respect to each testing sample. Specifically, the compressive load $\sigma p$ was adjusted to 566 MPa, 754 MPa, 943 MPa, 1320 MPa, and 1509 MPa. The above compressive loads correspond to cases where the ratio σp/σf is approximately 1.4, approximately 1.9, approximately 2.4, approximately 3.3, and approximately 3.8, respectively. In the following descriptions, "sample 1" refers to the sample processed under the condition σp/σf=approximately 1.4, "sample 2" refers to the sample processed under the condition σp/σf=approximately 1.9, "sample 3" refers to the sample processed under the condition σp/σf=approximately 2.4, "sample 4" refers to the sample processed under the condition σp/σf=approximately 3.3, and "sample 5" refers to the sample that is processed under the condition σp/σf=approximately 3.8.

After testing, the samples 1-5 were visually inspected, and it was confirmed that all the samples were free of cracks or defects.

(Evaluation)

The structures of the samples 1-5 after forging processes were performed thereon were observed using an optical microscope. FIG. 4 illustrates micrographs of samples 2 and 5 along with a micrograph of the pre-forging sample. Note that in FIG. 4, arrow LA represents the forging direction of the samples.

As can be appreciated from these observation results, deformation twins introduced into the structure may be increased, as the compressive load σp during the forging process is increased.

Figure 13:
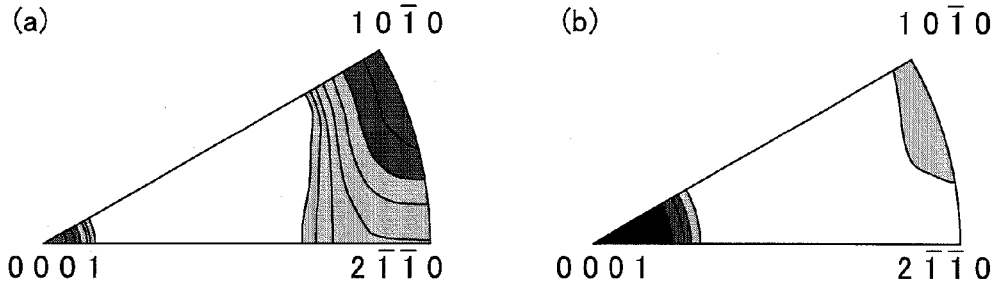
FIG. 13 illustrates results of measuring texture changes in the pre-forging sample (initial material) and sample 5 obtained through orientation imaging microscopy observation.

FIG. 13 illustrates measurement results of texture changes in the pre-forging sample (initial material) and sample 5 obtained through OIM by (Orientation Imaging Microscopy) observation. Specifically, FIG. 13 (*a*) illustrates the crystal orientation distribution of the initial material, and FIG. 13 (*b*) illustrates the crystal orientation distribution of sample 5. Note that observation of the initial material was made with respect to a cross-section of the initial material perpendicular to the extrusion direction. The observation of sample 5 was made with respect to a cross-section perpendicular to the compression direction. In FIG. 13, a darker region represents a region with a higher crystal orientation distribution in the corresponding direction, whereas a lighter region represents a region with a lower crystal orientation distribution.

As can be appreciated from FIG. 13 (*a*), in the initial material, crystals are aligned primarily in a direction perpendicular to the c-axis direction (0001), particularly, the crystal orientation (1010). Such characteristics are typical of hot extruded materials. That is, in the rod-shaped hot extruded material (initial material), the c-axis tends to be oriented in a direction perpendicular to the longitudinal direction of the rod.

On the other hand, as can be appreciated from FIG. 13 (*b*), in sample 5, crystals are aligned primarily in the crystal orientation (0001); namely, the c-axis direction. That is, in sample 5, the c-axis (0001) tends to be oriented parallel to the compression direction. This indicates that the c-axis direction is oriented parallel to the longitudinal direction of the rod.

The above results suggest that crystal rotation occurs as a result of implementing the method according to the present embodiment. It is quite common for the (0001) plane texture to be formed on a working surface. However, in the initial hot-extruded rod, the c-axis is oriented in a direction perpendicular to the longitudinal direction of the rod. On the other hand, the processed rod obtained by implementing the present embodiment has a texture with the c-axis oriented parallel to the longitudinal direction.

Normally, such a crystal rotation may be triggered only when substantial plastic deformation occurs in a material. Thus, in a hard-to-work material, such crystal rotation could only be observed in a broken sample. However, by implementing the method according to the present embodiment, a forging process may be performed on a workpiece without breaking the workpiece, and crystal rotation may occur after the forging process.

Next, tensile testing at room temperature was performed on the samples 1-5 to evaluate their strengths. The tensile test was performed using test equipment by Illinois Tool Works Inc. (Instron), and the initial strain rate was adjusted to $1\times10^{-3}$/sec.

Figure 14:
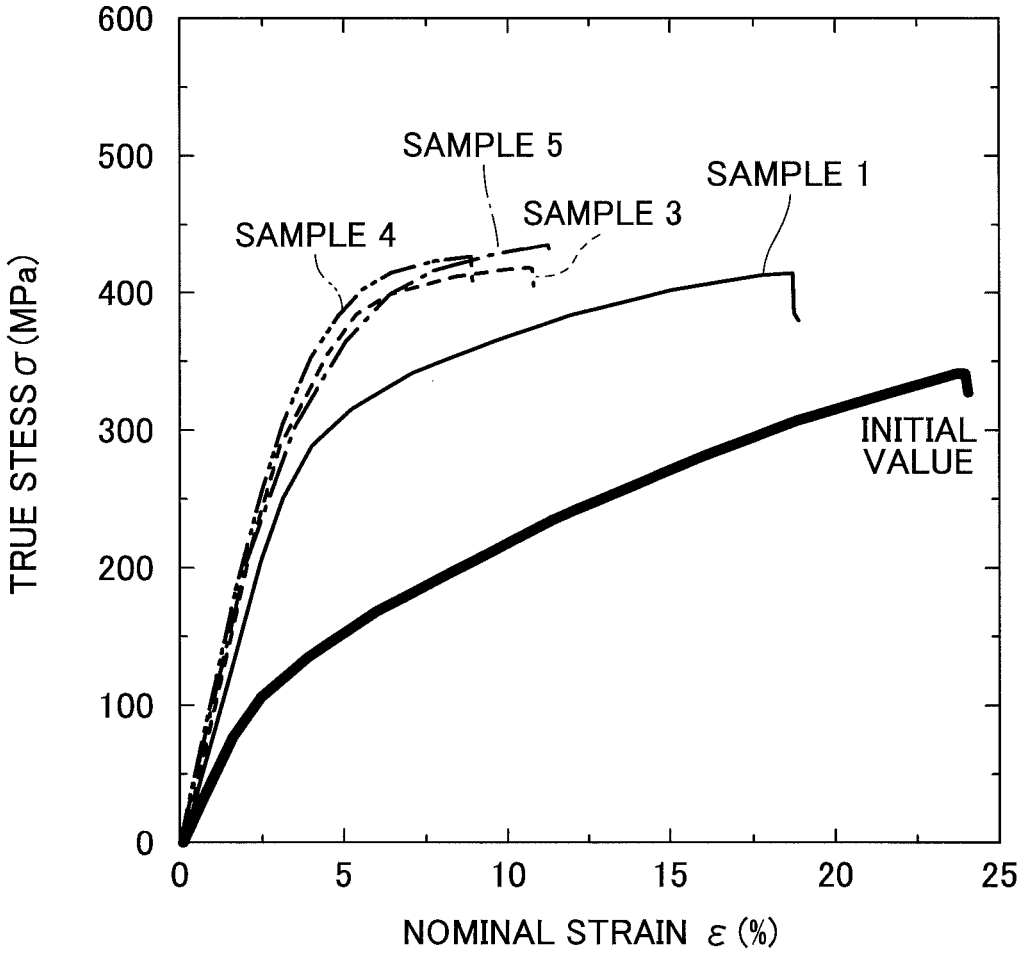
FIG. 14 is a graph illustrating compressive stress-strain curves of samples processes under different conditions and the compressive stress-strain curve of the pre-forging sample obtained through tensile testing.

FIG. 14 is a graph illustrating the true stress-nominal strain curves of sample 1 and samples 3-5. FIG. 14 also illustrates the true stress-nominal strain curve of the pre-forging sample.

As can be appreciated from these results, even in sample 1 that is processed under the condition σp/σf=approximately 1.4 (σp/σf≈1.4), the maximum tensile stress and the yield stress is substantially improved compared to the pre-forging sample. Further improvements in the maximum tensile stress and the yield stress can be observed in samples 3 (σp/σf≈2.4) through sample 5 (σp/σf≈3.8) compared to the pre-forging sample.

Also, the maximum tensile strength of each of the above samples exceeds 400 Mpa and is improved compared to the maximum tensile strength of the pre-forging sample (maximum tensile strength of approximately 350 Mpa). Further, the yield stress of each of the above samples is greater than or equal to 250 Mpa and is improved from the yield stress of the pre-forging sample (yield stress of approximately 100 MPa)

It can be confirmed from the above results that a high-strength magnesium alloy material can be produced by the method according to the present embodiment. Also, the elongation of each of the above samples was approximately 6% indicating that desirably high workability may be achieved by implementing the method according to the present embodiment.

The present application is based on and claims the benefit of priority of Japanese Patent Application No. 2011-143042 filed on Jun. 28, 2011, the entire contents of which are herein incorporated by reference.

DESCRIPTION OF REFERENCE NUMERALS

110 workpiece
112 top face
114 side face
116 bottom face
200 apparatus
215 inner space
220 mold
225 inner wall
230 base member
240 press mandrel
310 workpiece
314 side face
420 mold
415 inner space
428 bottom wall
440 press mandrel
620 mold
615 inner space
650 outer housing
660 inner mold
665A, 665B mold member
710 workpiece
815 inner space

820 mold
825 inner wall
830 base member
940 press mandrel
942 upper part
943 extension part
1031 base member
1031C concave part
1032 base member
1032P convex part
1041 base member
1041P convex part
1042 press mandrel
1042C convex part
P gap

The invention claimed is:

1. A method for producing a high-strength magnesium alloy material, the method comprising:

(a) a step of preparing a magnesium alloy workpiece having a top face and a side face; and (b) a step of applying a compressive load $\sigma p$ (MPa) from the top face side of the workpiece and performing a uniaxial forging process on the workpiece;

wherein step (b) is performed while suppressing deformation of the workpiece widening outward, at room temperature, and under conditions including (i) $10\sigma f > \sigma p > \sigma f$, wherein $\sigma f$ is the compressive breaking stress (MPa) of the workpiece;

(ii) a plastic deformation rate of the workpiece is less than or equal to 10%, and (iii) a strain rate of the workpiece is less than or equal to 0.1/sec.

2. The method as claimed in claim 1 wherein $\sigma p \geq 2.4\sigma f$.

3. The method as claimed in claim 1 wherein a mold having an inner space for accommodating the workpiece is used in step (b);

the inner space is formed by an inner wall of the mold; and assuming L denotes a maximum dimension of the top face of the workpiece, and P denotes a maximum gap between the side face of the workpiece and the inner wall of the mold, a ratio (L:P) is within a range from 20:1 to 600:1.

4. The method as claimed in claim 3, wherein the inner space of the mold is formed by assembling a plurality of mold members.

5. The method as claimed in claim 3 wherein the inner space does not penetrate through the mold.

6. The method as claimed in claim 3, wherein a size of the inner space varies along a depth direction of the inner space.

7. A rod made of a magnesium alloy, the rod having a crystal structure in which deformation twins are formed, and a crystal orientation distribution with the crystal orientation (0001) as a primary direction in a cross-section perpendicular to a longitudinal direction of the rod, wherein the rod has a maximum tensile strength with respect to the longitudinal direction of the rod exceeding 400 MPa and a yield stress greater than or equal to 250 MPa.

8. The rod made of a magnesium alloy as claimed in claim 7, wherein the magnesium alloy is an AZ-based magnesium alloy, a rare-earth-element-doped magnesium alloy, or a Ca-doped magnesium alloy.

9. A magnesium alloy material having a shape of a rod, a plate, a block, a pellet, or a tube, and having a compressive load applied in a predetermined direction, the magnesium alloy material comprising:

a crystal structure in which deformation twins are formed; and a crystal orientation distribution with the crystal orientation (0001) as a primary direction in a cross-section perpendicular to the predetermined direction in which the compressive load is applied, wherein the magnesium alloy material has a maximum tensile strength with respect to the predetermined direction in which the tensile load is applied exceeds 400 MPa and a yield stress greater than or equal to 250 MPa.

10. The magnesium alloy material as claimed in claim 9, wherein the magnesium alloy is an AZ-based magnesium alloy, a rare-earth-element-doped magnesium alloy, or a Ca-doped magnesium alloy.

* * * * *